US009995155B2

(12) United States Patent
Carnell

(10) Patent No.: US 9,995,155 B2
(45) Date of Patent: Jun. 12, 2018

(54) LOCKING MEMBER

(71) Applicant: ROLLS-ROYCE PLC, London (GB)

(72) Inventor: David Alan Carnell, Nottingham (GB)

(73) Assignee: ROLLS-ROYCE plc, London (GB)

( * ) Notice: Subject to any disclaimer, the term of this patent is extended or adjusted under 35 U.S.C. 154(b) by 303 days.

(21) Appl. No.: 14/853,261

(22) Filed: Sep. 14, 2015

(65) Prior Publication Data

US 2016/0097288 A1 Apr. 7, 2016

(30) Foreign Application Priority Data

Oct. 7, 2014 (GB) ..... 1417705.9

(51) Int. Cl.
*F01D 5/32* (2006.01)
*F01D 5/30* (2006.01)

(52) U.S. Cl.
CPC ..... *F01D 5/326* (2013.01); *F01D 5/3015* (2013.01); *F05D 2260/38* (2013.01)

(58) Field of Classification Search
CPC .... F01D 5/3015; F01D 5/326; F05D 2260/38; F16F 1/027; F16F 1/18–1/187; F16F 1/368–1/3686; F16F 1/3737; F16F 2230/0041; F16F 2230/30; F16F 2230/48; F16F 2232/08; F16F 2236/04; F16F 2236/045; F16F 2238/022
USPC ..... 267/158, 160, 163, 164, 165, 180
See application file for complete search history.

(56) References Cited

U.S. PATENT DOCUMENTS 2,847,187 A 8/1958 Murphy
4,953,834 A * 9/1990 Ebert ..... F16C 11/12 216/2
8,052,233 B2 * 11/2011 Netzer ..... A47B 95/043 16/85
8,959,737 B2 2/2015 Sweeting
9,277,034 B2 * 3/2016 Hazama ..... G06F 1/1624
2014/0209572 A1 * 7/2014 Williams ..... B23K 9/325 219/74
2015/0166199 A1 * 6/2015 Mistral ..... B64G 1/222 244/172.6

FOREIGN PATENT DOCUMENTS

DE 2457173 * 10/1976
EP 0712995 A1 5/1996
EP 1650406 A2 4/2006
GB 2258273 A 2/1993
JP S62-29703 A 2/1987
WO 2009/147366 A1 12/2009

OTHER PUBLICATIONS

Mar. 4, 2016 Search Report issued in European Patent Application No. 151847787.7.
Jun. 11, 2015 Search Report issued in British Patent Application No. 1417705.9.

* cited by examiner

*Primary Examiner* — Woody Lee, Jr.
*Assistant Examiner* — Brian O Peters
(74) *Attorney, Agent, or Firm* — Oliff PLC

(57) ABSTRACT

A lock apparatus securing a blade to a hub, the lock apparatus comprising a planar element having a spring actuable between an expanded position and a compressed position without deviation from the plane of the element, wherein in the expanded position of the spring the planar element is partly located in a slot provided in the blade, the spring being compressible to its compressed position to disengage the planar element from the slot.

12 Claims, 5 Drawing Sheets

LOCKING MEMBER

BACKGROUND OF THE INVENTION

The present disclosure concerns apparatus for securing a blade in a gas turbine and particularly a lock plate that inhibits axial movement of a blade relative to the hub.

FIG. 1 depicts an high pressure compressor disc 2 of a gas turbine engine. The disc 2 has a plurality of axial slots 4 extending into the disc from its circumferentially outer surface 6 with the slots being arranged in an array that extends around the circumference of the disc. Each slot is shaped to receive a blade root with the shape of the slot and the corresponding shape of the root being designed to hold the blade within the disc despite the centripetal forces on the blade as the disc rotates in use. The slot may be formed as a dovetail 8, a fir tree, or other suitable shape.

To inhibit axial movement of the blade in the slot 4 in use one or more lock plates are provided. These plates are located partly within a circumferential slot 10 that is defined in part by an overhang 12 in the disc hub and in part by an overhang 14 in the blade 16. Each overhang is provided by a forward extension projected from the hub or blade root and which has a radially inwardly extending portion at its distal end.

The plates are inserted within the slot to engage the fixed overhangs on the disc and the translatable overhangs on the blade to inhibit the axial movement of the blade relative to the disc. A lock plate or lock plates are provided to secure prevent the plates from becoming detached from the slot. In one known example of a lock plate the plate is formed out of a planar sheet that is bent out of plane to provide a curved cross-section. The curvature is sufficient to shorten the width of the lock plate so that it can be inserted within the slot after which it is straightened e.g. by applying a force—impact or continuous—to lock the plate within the slot.

At overhaul the lock plate is destructively removed e.g. by cutting or levering the lock plate from the slot to release the blades from the disc. By this method of removal there is a reasonable risk of loss of the lock plate that would have to be re-found before the engine could be put back into service, or damage to the disc that may subsequently need to be scrapped.

OBJECT AND SUMMARY OF THE INVENTION

It is an object of the invention to seek to address these and other problems.

According to an aspect there is provided a lock apparatus securing a blade to a hub, the lock apparatus comprising a planar element having a spring actuable between an extended position and a compressed position without deviation from the plane of the element, wherein in the extended position of the spring the planar element is partly located in a slot provided in the blade, the spring being compressible to its compressed position to disengage the planar element from the slot, wherein one or more guides (34) is provided to limit either the maximum compression or maximum extension of the spring, the guides being walls either side of the spring, each wall having a portion extending from the base portion and a portion extending from the top portion, one of the wall portions having a stop surface (28) that engages a tab on the other of the wall portions.

The slot is preferably located in the side of a blade platform facing the hub. The slot is preferably a slot portion that together with other slot portions provides the circumferential slot that extends around the circumference of the hub. The blade slot portions alternate with slot portions formed in the securing walls that engage the blade root.

The planar element may have a base portion and a top portion, the spring connects between the base portion and the top portion and permits relative translation of the base portion towards and away from the top portion.

The spring may be connected to the top portion through an actuation feature having a profile for engaging an actuation tool. The actuation feature may be a slot.

One or more further actuation features may be provided having a profile for engaging an actuation tool, wherein the actuation feature is configured to have a spacing from the further actuation features that is adjustable by compression or extension of the spring.

The base portion may have a profile that mirrors that of the hub and wherein the top portion has a profile that mirrors that of the slot.

The lock apparatus may comprise multiple planar elements including first and second cover planar elements sandwiching the planar element comprising the spring.

According to a second aspect there is provided a method of locking a blade to a hub, the blade having a slot in a blade platform, the method comprising the steps of providing a lock apparatus comprising a planar element having a spring actuable between an extended position and a compressed position without deviation from the plane of the element, locating the lock apparatus relative to the slot in a disengaged position wherein the spring is compressed and extending the spring to engage the lock apparatus with the slot.

An actuation tool may be used to engage an actuation feature in the lock apparatus to effect extension and compression of the spring.

The actuation tool may engage further actuation features in the lock apparatus and a lever is actuated to adjust the relative spatial position of the actuation feature provided in the lock apparatus to the further actuation features in the lock apparatus.

The skilled person will appreciate that except where mutually exclusive, a feature described in relation to any one of the above aspects of the invention may be applied mutatis mutandis to any other aspect of the invention.

BRIEF DESCRIPTION OF THE DRAWINGS

The invention will now be described by way of example only and with reference to the accompanying drawings in which.

DETAILED DESCRIPTION

Figure 1:
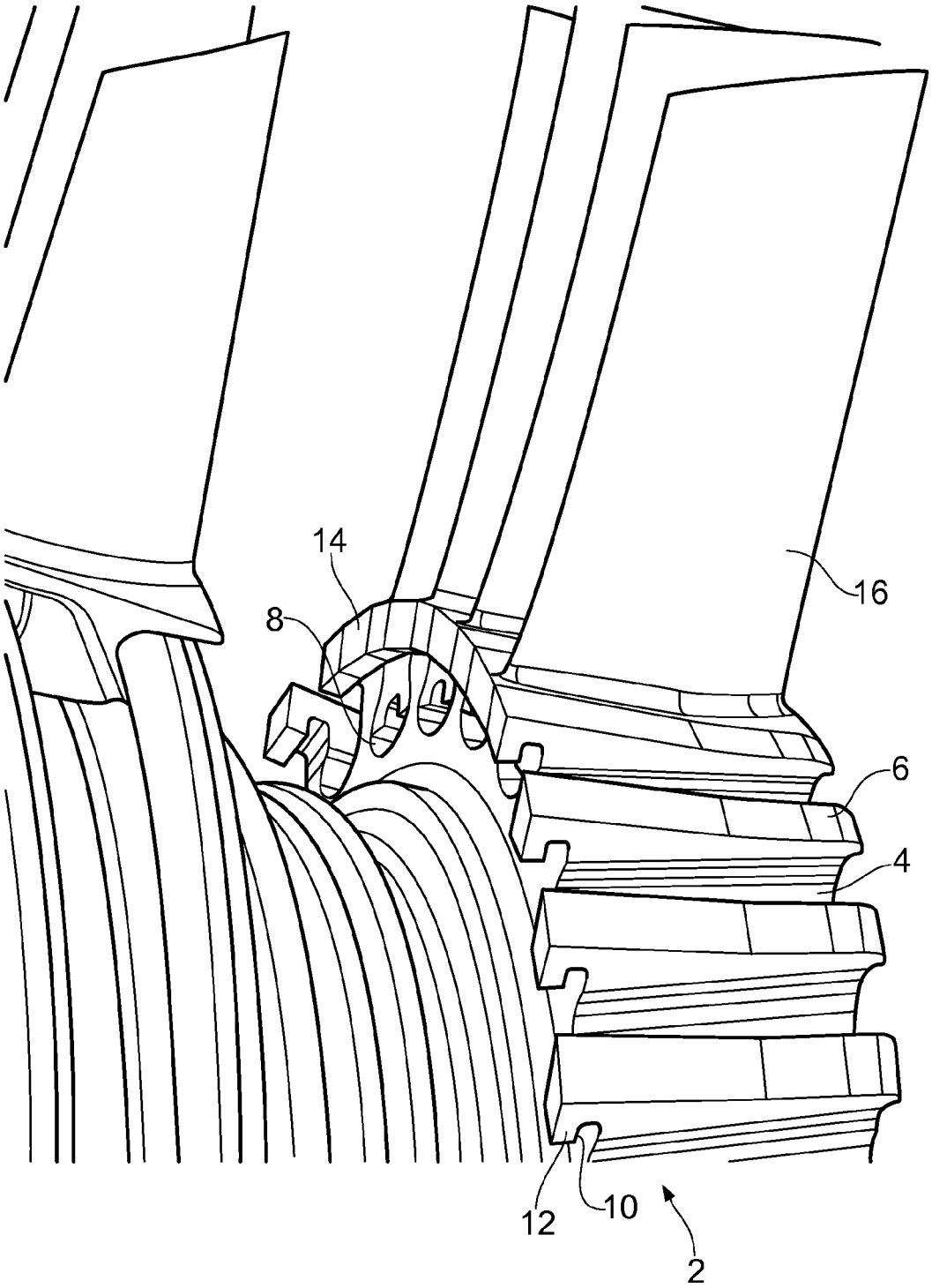
FIG. 1 depicts a compressor blade and hub arrangement.
Figure 2:
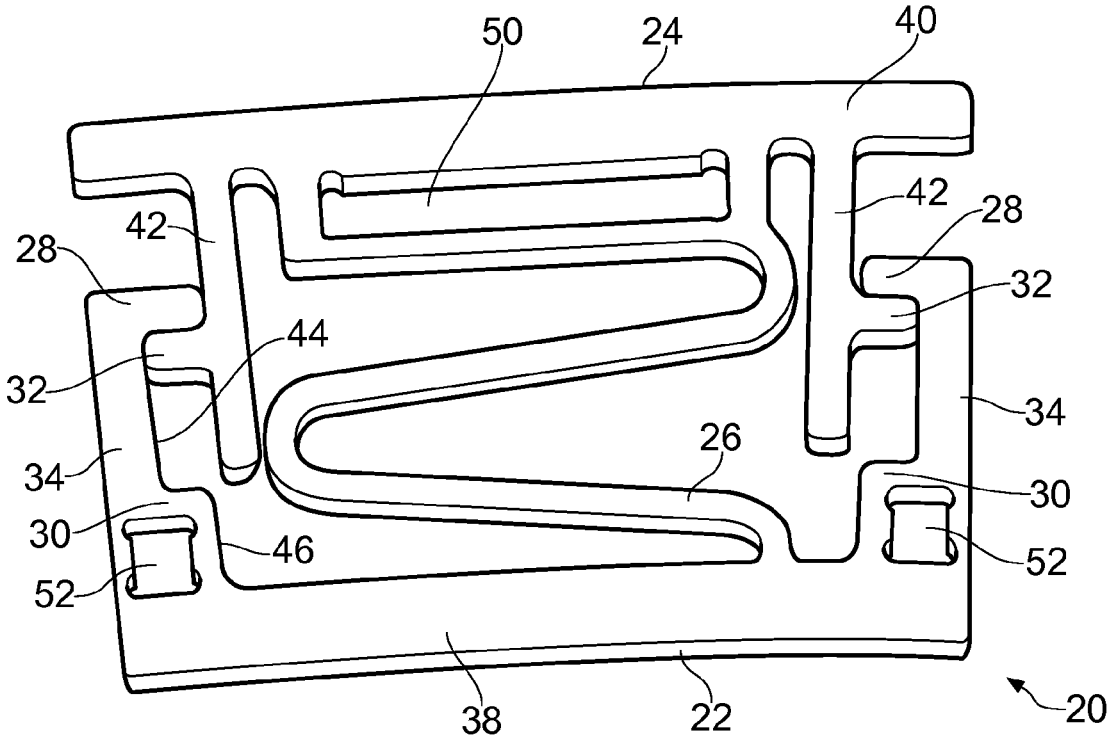
FIG. 2 depicts an embodiment of a lock plate.

FIG. 2 depicts an embodiment of an exemplary lock plate 20 in accordance with the invention. The lock plate is a single piece component that has a first surface 24 that engages against the radially outer surface of the retaining slot and a second surface 22 that engages against the surface of the disc. Both surfaces are biased away from each other by a spring element 26. Both the first surface and the second surface may be provided with an optional profile that matches the surfaces against which they are forced by the spring element. Usually the profiles will have a slight radius that is equal to either the overhang or the disc and which ensures an accurate location of the lock plate. The profiles can help to ensure the lock plate is inserted in the correct orientation as mistakes are easily observable.

Guides may be provided that limit either the maximum or minimum separation of the first and second surfaces. In the embodiment shown the guides comprise walls 34 either side of the spring 26. Two walls 34 extend from a base plate 38 that incorporates the second surface 22 and two walls 42 extend from a top plate 24 that incorporates the first surface 24. The walls 34 from the base plate are laterally outside the walls 42 from the top plate and all have distal and proximal ends. The distal end of the bottom side walls 34 has a guide surface 44 and a stop surface 28 and the proximal end has a guide surface 46 and a stop surface 30. Each of the stop surfaces 28, 30 are parallel and each of the guide surfaces 44, 46 are parallel.

The stop surfaces 28, 30 are spaced apart to provide a gap within which a tab 32 that protrudes from the walls from the top plate can translate. The tab abuts the proximal end stop surface when the spring is in its extended position and abuts the distal end stop surface when the spring is in its contracted position. The wall from the top plate slides relative to the guide surfaces to ensure accurate translation of the top surface relative to the bottom surface.

The lock plate is desirably made of a material that has a suitable natural plasticity allowing it to be plastically deformed without fracture. An appropriate material is titanium though it will be appreciated that other materials may be used depending on the final intended application of the lock plate. For example a material resistant to a higher temperature may be required if the lock plate is to be used in the turbine section of the gas turbine.

The lock plate may be manufactured to a high accuracy by laser cutting the sheet of material. Where possible the laser traverses relative to the sheet and cuts in a single, or a few paths, to maximise manufacture speed and accuracy. The use of a laser allows the lock plate to be manufactured to high tolerance and to profiles that match the disc or rim overhang.

The lock plate is provided with actuation feature 50 adapted to engage with a tool to facilitate optimal actuation of the spring. Whilst it is desirable that the actuation feature is provided within the bounds of the lock plate it may also project from the surface. Where the actuation feature is provided within the bounds of the lock plate the simplest embodiment is provided by an aperture of a profile complementary to that of a portion of an actuation tool. The aperture is of a size that provides an interference fit with the corresponding engagement portion of the tool so that the clip does not easily become released from the tool. The actuation feature of FIG. 2 is provided by a slot 50 between the spring 26 and the top plate 40. Side walls join the spring to the top plate to help ensure that the spring translates without rotation. Depending on the tool used to actuate the spring, further actuation features 52 may be provided close to the bottom wall that help to react forces from the tool on the lock plate.

Figure 3A:
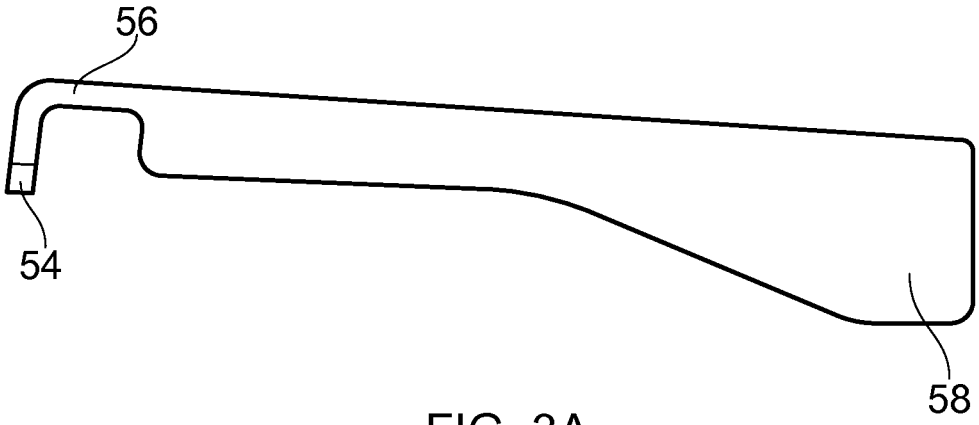
FIGS. 3A and 3B depict an embodiment of tool for facilitating the insertion and removal of the lock plate.
Figure 3B:
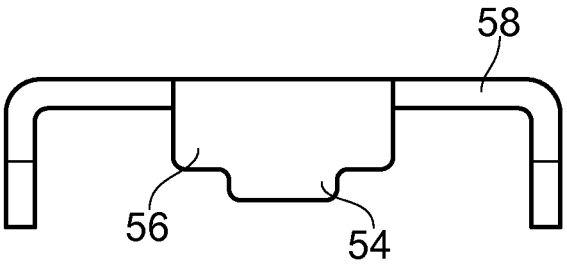
Figure 4:
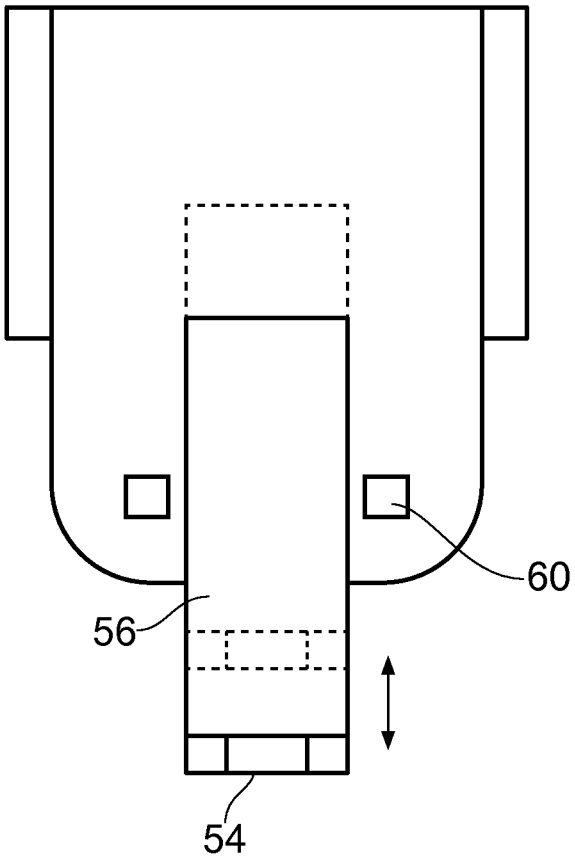
FIG. 4 depicts an alternative embodiment of a tool for facilitating the insertion and removal of the lock plate.

An exemplary tool for placing the lock plate in position is shown in FIG. 3. FIG. 3A depicts a side view and 3B the front view of the tool. The tool has a portion 54 adapted to be located within the actuation slot of the lock plate, or against or within the actuation feature of the lock plate. At its simplest the tool is a sheet with a tenon 56 that is bent 90 degrees out of the plane of the sheet. In a more complex arrangement as depicted in FIG. 4, which is a view from the underside of the tool, the tenon 56 slides relative to the tool handle 58 in the direction of the arrows from an extended position show in solid lines to a retracted position shown by a dashed line. A lever is used to control the position of the tenon 56 and actuate its movement. Pins 60 are provided in a fixed orientation to the handle 58 such that, by sliding the lever, the distance may be varied between the pins and the portion 54 adapted to be located within the actuation slot.

In order to locate the lock plate into the engine the lock plate is mounted onto the actuation portion and the base of the lock plate is set against the hub. The tool is then moved to compress the spring to and the lock plate moved into position with regard to the slot. The spring is allowed to expand to secure the lock plate into the slot and the tool then detached from the lock plate.

Removal of the lock plate is achieved reversing the above steps.

With the alternative tool of FIG. 4 the lock plate is mounted on the tool by engaging the pins 60 into the further actuation features 52 and the actuation portion 54 into the lock plate slot 50. The actuation portion 54 is moved by the lever relative to the pins to compress the spring 26. As before the lock plate is mounted into position within the slot and the spring subsequently allowed to expand before the tool is detached from the lock plate.

Figure 5:
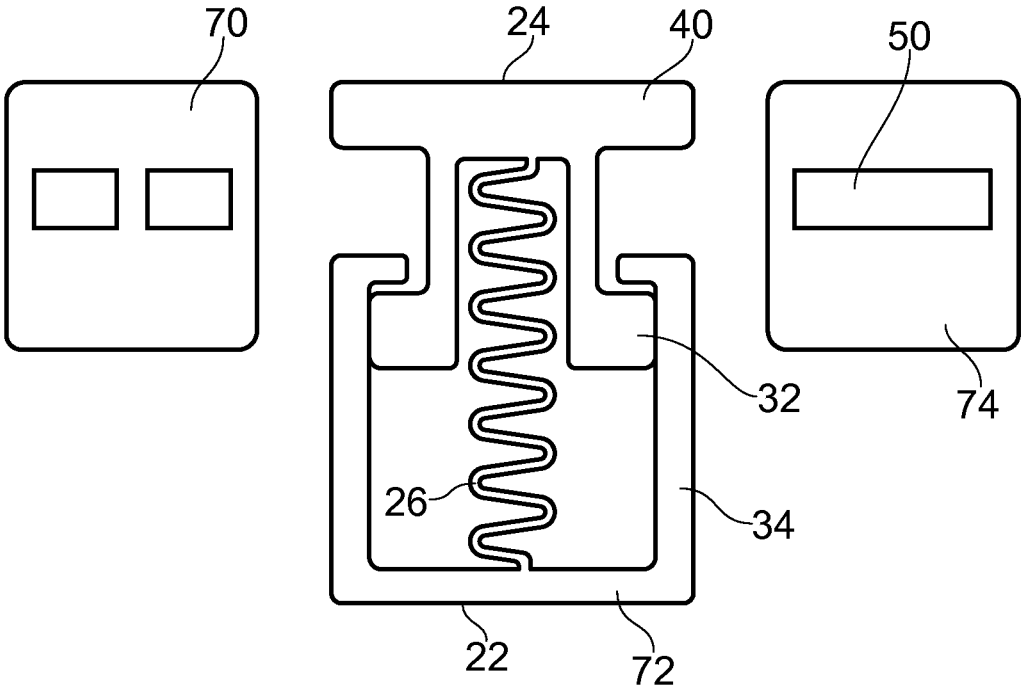
FIG. 5 depicts an alternative embodiment of a lock plate.

FIG. 5 depicts an alternative arrangement for the lock plate. In this embodiment three plates are used: a bottom cover plate 70, a spring plate 72 and a top cover plate 74. The three plates are laminated and held together by rivets, welds or other joining methods. The top and bottom plates individually, or together, add stiffness and inhibit twist of the spring. This allows the spring to be either of longer length than in the earlier embodiment, of lower stiffness, or both which facilitates the location of the lock plate into position. The cover plates may incorporate the actuation feature for receiving the tool.

It will be understood that the invention is not limited to the embodiments above-described and various modifications and improvements can be made without departing from the various concepts described herein. Except where mutually exclusive, any of the features may be employed separately or in combination with any other features and the invention extends to and includes all combinations and sub-combinations of one or more features described herein in any form.

The invention claimed is:

1. A lock apparatus securing a blade to a hub, the lock apparatus comprising a planar element having:

a first portion;

a second portion;

a spring between the first portion and the second portion, the spring being actuable between an expanded position and a compressed position without deviation from the plane of the element, wherein in the expanded position of the spring the planar element is partly located in a retaining slot provided in the blade, the spring being compressible to its compressed position to disengage the planar element from the retaining slot; and a guide provided to limit either the maximum compression or maximum extension of the spring, the guide comprising a wall on a side of the spring, the wall having a first wall portion extending from the first portion and a second wall portion extending from the second portion, the first wall portion having a stop surface that engages a tab on the second wall portion.

2. The lock apparatus according to claim 1, wherein the spring connects between the first portion and the second portion and permits relative translation of the first portion towards and away from the second portion.

3. The lock apparatus according to claim 2, wherein the spring is connected to the second portion through an actuation feature including a slot and having a profile for engaging an actuation tool, the actuation tool including a tenon with an engagement portion at an end thereof that engages the slot.

4. The lock apparatus according to claim 3, wherein one or more further actuation features are provided having a profile for engaging the actuation tool, wherein the actuation feature is configured to have a spacing from the further actuation features that is adjustable by compression or extension of the spring.

5. The lock apparatus according to claim 1, wherein the first portion is a base portion and has a profile that mirrors that of the hub and wherein the second portion is a top portion and has a profile that mirrors that of the retaining slot of the blade.

6. The lock apparatus according claim 1, wherein the lock apparatus comprises multiple planar elements including first and second cover planar elements sandwiching the planar element comprising the spring.

7. A method of locking a blade to a hub, the blade having a retaining slot in a blade platform, the method comprising the steps of;

providing a lock apparatus comprising a planar element having a first portion, a second portion and a spring between the first portion and the second portion, the spring being actuable between an extended position and a compressed position without deviation from the plane of the element; locating the lock apparatus relative to the retaining slot in a disengaged position, wherein the spring is compressed; and extending the spring to engage the lock apparatus with the retaining slot, wherein the spring is guided by a guide that limits either the maximum compression or maximum extension of the spring, the guide comprising a wall on a side of the spring, the wall having a first wall portion extending from the first portion and a second wall portion extending from the second portion, the first wall portion having a stop surface that engages a tab on the second wall portion.

8. The method according to claim 7, further comprising engaging an actuation tool including a tenon with an engagement portion with an actuation feature in the lock apparatus to effect extension and compression of the spring, the actuation feature including a slot that receives the engagement portion.

9. The method according to claim 8, wherein the actuation tool engages further actuation features in the lock apparatus and a lever is actuated to adjust the relative spatial position of the actuation feature provided in the lock apparatus to the further actuation features in the lock apparatus.

10. The lock apparatus according claim 1, wherein the planar element further comprising a second guide provided to limit either the maximum compression or maximum extension of the spring, the second guide comprising a second wall on an opposite side of the spring relative to the guide in the plane of the element, the second wall having a third wall portion extending from the first portion and a fourth wall portion extending from the second portion, the third wall portion having a second stop surface that engages a second tab on the fourth wall portion.

11. The method according to claim 7, wherein the planar element further comprising a second guide provided to limit either the maximum compression or maximum extension of the spring, the second guide comprising a second wall on an opposite side of the spring relative to the guide in the plane of the element, the second wall having a third wall portion extending from the first portion and a fourth wall portion extending from the second portion, the third wall portion having a second stop surface that engages a second tab on the fourth wall portion.

12. The method according to claim 7, wherein the first portion is a base portion and has a profile that mirrors that of the hub and wherein the second portion is a top portion and has a profile that mirrors that of the retaining slot, and extending the spring to engage the lock apparatus with the retaining slot further comprises engaging the first portion with the hub and the second portion with the retaining slot.

* * * * *